United States Patent [19]

Muller

[11] 4,341,934

[45] Jul. 27, 1982

[54] ACTUATOR FOR KEYBOARD SWITCHES

[75] Inventor: Michael Muller, Newport Beach, Calif.

[73] Assignee: The Keyboard Company, Garden Grove, Calif.

[21] Appl. No.: 208,672

[22] Filed: Nov. 21, 1980

[51] Int. Cl.[3] ..... H01H 3/12

[52] U.S. Cl. ..... 200/159 A; 200/159 R; 200/5 A

[58] Field of Search ..... 200/159 A, 159 B, 159 R, 200/330, 340, 5 A, 5 R

[56] References Cited

U.S. PATENT DOCUMENTS 3,780,237 12/1973 Seeger et al. ..... 200/340
3,909,564 9/1975 Scheingold et al. ..... 200/5 A
4,063,054 12/1977 Hirata ..... 200/159 R
4,099,037 7/1978 Hartzler ..... 200/5 A
4,192,976 3/1980 Scott ..... 200/5 A

*Primary Examiner*—John W. Shepperd
*Attorney, Agent, or Firm*—Blakely, Sokoloff, Taylor & Zafman

[57] ABSTRACT

A resilient metallic actuator and contact, for use with keyboard switches, designed to provide a specific tactile effect to the keyboard operator. The preferred actuator is a double member actuator. The first member provides a resting spring bias to the key. The second member provides a significant increase in the spring bias force slightly prior to the switch making contact. In one embodiment the actuator activates a dome like over center contact to close the switch. In an alternate embodiment the second actuator member is configured to perform the function of a contact member.

11 Claims, 11 Drawing Figures

Fig. 4
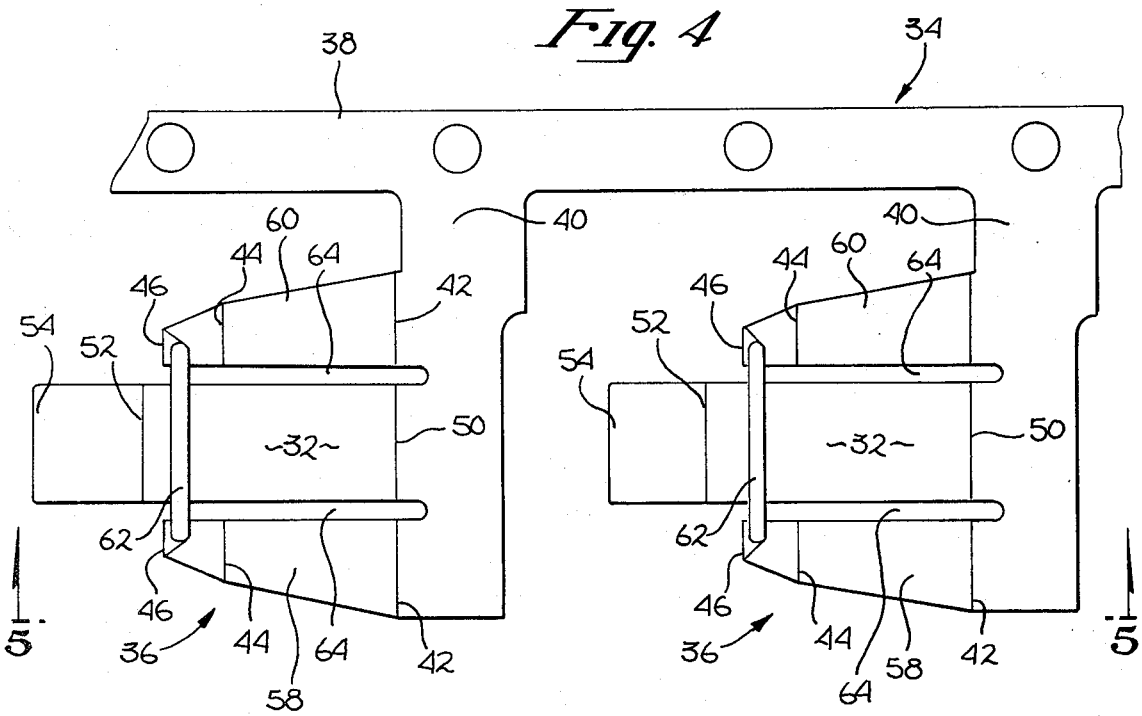
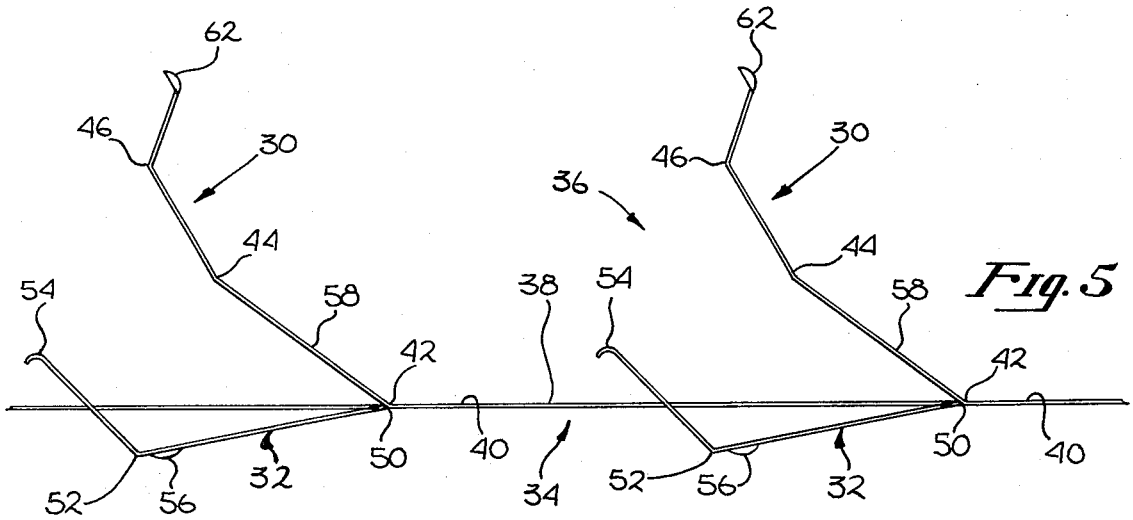
Fig. 5
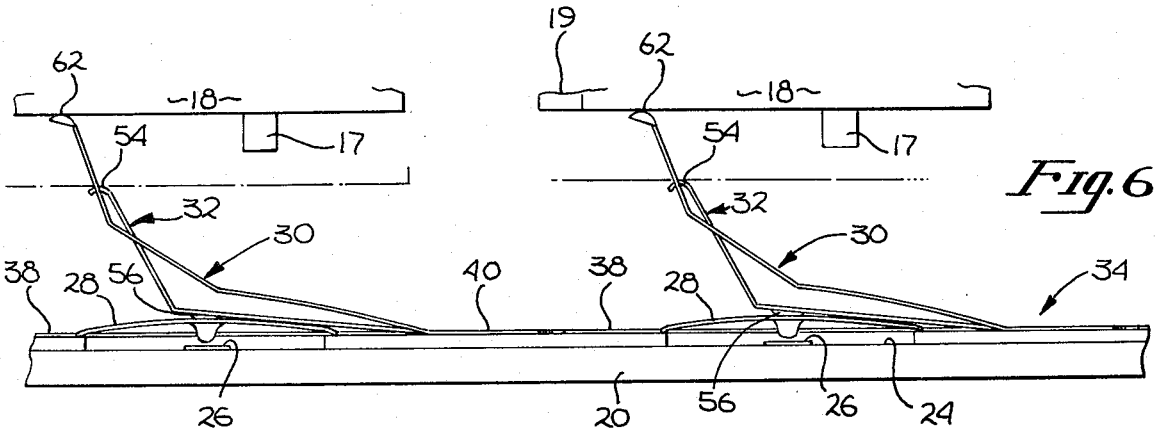
Fig. 6

ACTUATOR FOR KEYBOARD SWITCHES

SUMMARY OF THE INVENTION

The invention comprises a double member actuator designed for use with keyboard switches. Both actuator members are formed from a single sheet of metal and after formation remain integrally connected. The first actuator member is bent at its base so that its length is fully extended above the plane of the sheet of metal. The second actuator member is bent so that part of its length extends below and another part of its length (i.e., its free end) extends just above the plane of the sheet of metal. When this double member actuator is installed in place above a contact member, the first actuator member remains out of contact with the second, even though the second actuator is required to be moved entirely above the plane of the sheet of metal by the presence of the contact member. Thus the second actuator member is biased into constant contact with the dome like contact member. One portion (i.e., the free end) of the second actuator member extends well above the contact member even though the other portion is biased into contact with the contact member.

The resilience of the first actuator member is sufficient to support the weight of a key member in its rest position and still maintain its free end above the free end of the second actuator member.

When a keyboard operator first presses against a key, the resistance of the key to movement is measured by the resilience of the first actuator member only. When the key has been depressed a sufficient distance it will cause the key to encounter the free end of the second actuator member. The resilience of this second actuator member then also contributes to the resistance of the key to movement and produces a noticeable increase in force required to depress the key. Additional depression of the key begins to deform the dome-like contact member toward making contact. The result is a pleasing, positive tactile effect for the keyboard operator.

A second embodiment is disclosed wherein, for economy, the dome-like contact member is eliminated. In this structure the second actuator member is formed to function as the contact member, as well as a "second actuator." This is accomplished by bending the second actuator such that in its free state it lies entirely above the plane of the sheet of metal from which it was formed. When installed, the first actuator member thus lies above and is spaced apart from the second actuator member which itself lies above and is spaced apart from the point of making contact. Thus, as before, when the keyboard operator first depresses a key the resistance of the key to movement is measured by the resilience of the first actuator member only. When the key has been depressed sufficiently it will encounter the resilience of the second actuator member. But since the second actuator is not pre-biased against a contact member, its resilience will be less than in the previous embodiment. Thus, its contribution to the resistance of the key to movement will be less, and the increase in resistance will be less noticeable, than in the first embodiment. Continued depression of the key will cause the second actuator member to make contact with the contact point. Hence, the second actuator member, in this second embodiment, also functions as a contact member. The tactile "feel" of this second embodiment is less ideal than the first embodiment, but it is more economical to manufacture.

BRIEF DESCRIPTION OF THE FIGURES

FIG. 4 shows a top plan view of the actuator assembly of the present invention.

FIG. 5 shows a side view of the actuator assembly.

FIG. 6 is an illustration of the actuator assembly as installed in a key housing.

DETAILED DESCRIPTION OF THE INVENTION

Figure 1:
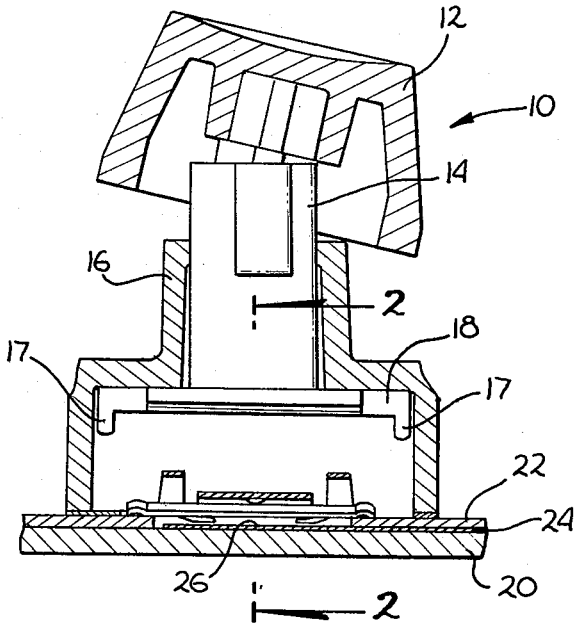
FIG. 1 shows a key assembly such as may be used to enter data to a data processor.

In the computing industry it is quite common that data can be entered into a computer by means of a keyboard. Such a keyboard may be comprised of a number of keys such as key 10 illustrated in FIG. 1. The key 10 comprises a cap 12 matingly engageable with a shaft 14 which is slidably moveable vertically within a housing 16. At the bottom of the shaft 14 there is a base 18 which is provided with feet 17, its function to be explained below. Such a key is typically mounted above a printed circuit board 20 provided with an insulator 22 to electrically insulate the printed circuit conductors such as 24 from the switching mechanism which is normally housed beneath the base 18 within housing 16. The printed circuit conductor 24 typically will terminate in a contact pad such as 26.

Figure 2:
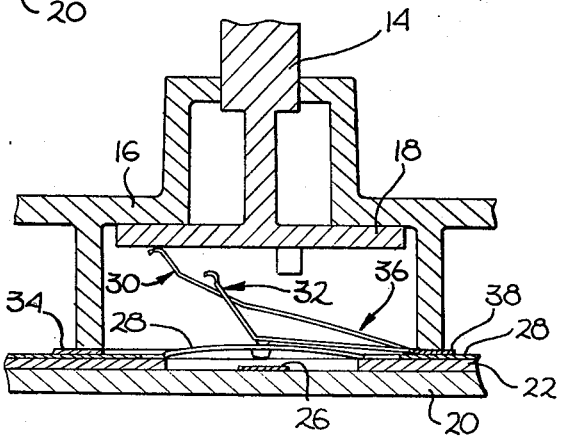
FIG. 2 shows such a key assembly in which is utilized the switch actuator assembly of the present invention.

The contact pad 26 forms one pole of a switching mechanism which when closed by operation of the key 10 produces an electrical signal which is representative of information which is desired to be entered into a computing system. The other pole of the switch assembly, which is the subject of the present invention, is more thoroughly illustrated in FIG. 2. As shown in FIG. 2 the other pole comprises a contact member 28 which when sufficiently depressed will make physical contact with a contact pad 26 thereby closing a circuit and entering the data into the computing system. This contact member 28 must be actuated by a further device. This further device is typically referred to as an actuator assembly. The actuator assembly 36 illustrated in FIG. 2 is comprised of a first actuator member 30 and a second actuator member 32. Both first actuator member 30 and second actuator member 32 are formed from a single sheet of material and remain integrally connected to one another. Each actuator assembly 36 may be connected to the actuator assembly of an adjacent key 10 of a keyboard by means of a buss 38 which is also part of the same integral sheet of metal 34. As shown in FIG. 2 the first actuator member 30 is, in its installed position, in contact with the underside of the base pad 18 of the shaft 14. This first actuator member 30 thus resiliently biases the shaft 14 and the cap 12 in its resting position.

Figure 3:
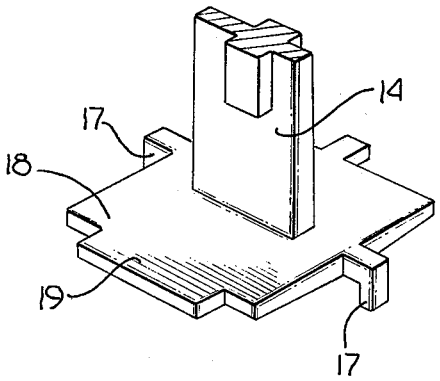
FIG. 3 shows the key shaft and pad.

The configuration of this shaft 14 and its base pad 18 are more clearly illustrated in FIG. 3. The shaft 14 terminates in a base pad 18 which is provided with a forward tab 19 which is the portion of the base pad 18 which actually makes contact with the first actuator member 30. The base pad 18 is also provided with a pair of depending feet 17 which insure that the underside of the base pad 18 does not extend so far downward as to crush and therefore deform or damage the actuator assembly 36 or the contact member 28 and the contact pad 26 on the underlying printed circuit board 20. Without such feet 17 the underside of the pad 18 could be depressed a distance which might otherwise damage the delicate structure of the actuator assembly 36 more fully illustrated in FIGS. 4 and 5.

Each and every element shown in FIGS. 4 and 5 is formed from a single integral sheet of metal. The actuator assemblies 36 are connected by arms 40 to a buss 38 which interconnects the various actuator assemblies 36. The first actuator member 30 comprises a first arm 58, a second arm 60 and a connector 62. This first actuator member 30 is bent at its base 42 and is provided with additional bends 44 and 46 prior to its termination in connector 62. The second actuator member 32 also is bent at its base 50 and intermediate its ends as at 52 as shown in FIG. 5. The free end of the second actuator member 32 is provided with a smooth rounded end 54. Along the length of the second actuator member 32, and at a position proximate the bend 52, there is provided a knob 56 which may be formed by a depression made in the other side of the second actuator member 32. This knob 56 serves as a fulcrum during the operation of the actuator assembly 36 as will be more fully explained below.

Figure 4A:
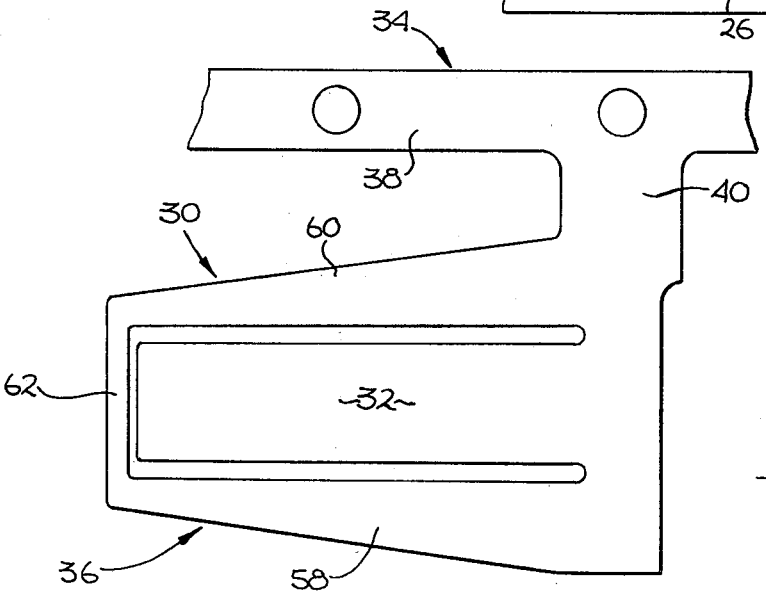
FIG. 4*a* shows a top plan view of the stamped actuator assembly of FIG. 4, prior to bending.

The first actuator member 30 and the second actuator member 32 are formed by stamping them from an originally flat integral sheet of metal 34 as shown in FIG. 4*a*. The separation between the first actuator member 30 and the second actuator member 32 is provided by a notch or by a slot 64 which defines the interior perimeter of the first actuator member 30 and the exterior perimeter of the second actuator member 32. After the first actuator member 30 and second actuator member 32 have been stamped from the originally flat sheet of metal 34 they are bent to the configuration shown in FIG. 5 in preparation for their installation. As shown in FIG. 5 the first actuator member 30 is bent upwardly, that is the first actuator member 30 extends entirely above the plane of the original sheet of metal 34. This is accomplished by bending the first actuator member 30 at its base along bend 42. The bend is sufficiently high to keep the free end 62 of the first actuator member 30 above the second actuator member 32 when it is in the installed position. The second actuator member 32 is bent in the opposite direction about the bend line 50 such that the majority of the length of the second actuator member 32 extends below the plane of the original sheet of metal 34 and only the free end 54 of the second actuator member 32 extends above the original sheet of metal 34. This leaves the second bend 52 and the knob 56 both below the level of the plane of the original sheet of metal 34.

Because of the above described bent configuration of the actuator assembly 36 as shown in FIG. 5, installation of the actuator assembly 36 above a contact member 28, such as shown in FIG. 6 causes the second actuator member 32 to be bent back upward and above the contact member 28 such that the knob 56 remains in constant contact with the top of the contact member 28. The degree of bending of actuator member 32 can be adjusted to vary the preloading applied to the contact member 28. This may be adjusted to optimize the hysterisis of the contact member and may be adjusted to set the force required to be applied to the key 10 to snap the contact member 28 through center. As shown in FIG. 6 the base pad 18 of the shaft 14 in the installed position is in contact with the connector 62 of the first actuator member 30. That is, the key 10 is resiliently biased by the first actuator member 30. The first actuator member 30 is held in this position, by its resilience, above the free end 54 of the second actuator member 32. Depression of the key 10 will cause the base pad 18 to move against the first actuator member 30 and the resistance of the key 10 to depression will be measured by the resilience of the first actuator member 30. Once the key 10 has been depressed a sufficient distance the free end 54 of the second actuator member 32 will be encountered and its resilience, as measured about the knob 56 which serves as a fulcrum, will be added to the resilience of the first actuator assembly 30 to noticeably increase the resistance to movement of the key 10 and shaft 14. Further depression of the shaft 14 or of the key 10 will result in an increase in force which is applied to the upper surface of the contact member 28 and at one point the force will be sufficient to actuate the contact member 28 and thereby close the switch, that is, the contact member 28 will make electrical contact with the contact pad 26. This change in the amount of force required to depress the key 10 may be illustrated as shown in FIG. 7.

The first line segment 66 is representative of the resilience of the first actuator member 30. The second line segment 68 is representative of the sum of the resilience of the first actuator member 30 and of the second actuator member 32 as measured about the knob 56 acting as a fulcrum. This force continues to increase as the key 10 is depressed until the force level required to make contact is achieved. At that point the force decreases quickly, such as at 72, and contact is made. From that point on the amount of force required to depress the key rises quite sharply and eventually reaches the physical limitations which prohibit further depression of the key 10.

Figure 7:
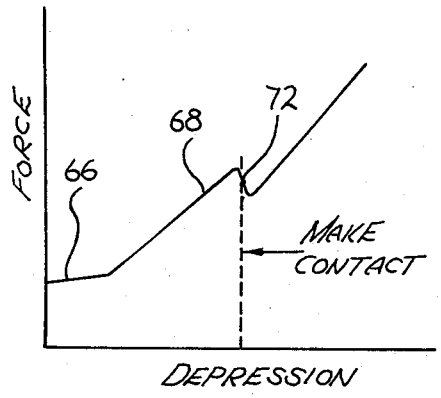
FIG. 7 illustrates the tactile characteristic of the present actuator assembly.

The plot of depression force versus the amount of depression as shown in the graph of FIG. 7 represents a close approximation of what might be considered to be an ideal feel or tactile sensation which can be exhibited by a key. Line segment 66 represents the level of force which informs an operator that the key has been moved but no contact has been, or is about to be, made. The rate of increase of force represented by line segment 68 tells an operator that contact, i.e., contact between the contact member 28 and contact pad 26 is about to be made. This increased force serves as a warning to the operator and tends to reduce unintentional key closures. Such a characteristic gives the operator a positive and sure feel regarding the making of contact between the contact member 28 and contact pad 26, and allows the fingers of the operator to "float" over the keys without being dangerously close to unintentional key closure. This promotes fast and accurate typing.

Figure 8:
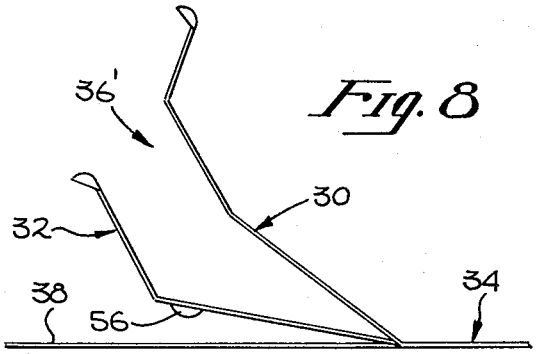
FIG. 8 is an alternate embodiment of the actuator assembly.
Figure 9:
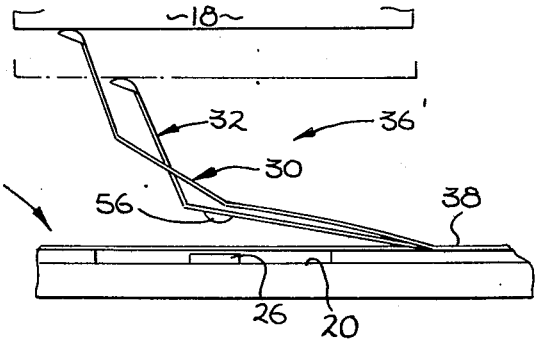
FIG. 9 illustrates the installed alternate embodiment permitting elimination of an element.

While the above describes the preferred actuator assembly 36 of the present invention it is evident that a significant cost savings may be effectuated by the modification illustrated by the alternate embodiment shown in FIGS. 8 and 9. The actuator assembly 36' of FIG. 8 is identical to the actuator assembly 36 of FIG. 5 with the exception that the second actuator member 32 in its free state has been bent upwardly such that the entire length of the second actuator member 32 lies above the plane of the original flat sheet of metal 34. The second actuator member 32 has further been bent upward sufficient such that the free end of the first actuator member 30 remains above and second actuator member 32 and, the second actuator member 32 is spaced apart from the contact pad 26 on the underlying printed circuit board 20. Initial depression of the key 10 will therefore cause the base 18 to experience the resistance offered by the first actuator member 30. This will serve to bias the key 10 in its resting position and to afford the initial resistance to movement of the key 10. Additional depression of the key 10 or base pad 18 will eventually cause the base pad 18 to encounter the second actuator member 32. The total resistance to movement of the key 10 will therefore be the sum of the forces exerted by the first actuator member 30 and the second actuator member 32. As shown in FIG. 9, however, it should be noted that this second embodiment of the actuator assembly 36' does not employ a contact member 28. Instead, further depression of the base pad 18 will cause the second actuator member 32 to itself make contact (at the knob 56) with the contact pad 26 there beneath. In this way the second actuator member 32 serves both as a second actuator member 32 and as a contact member which latter function was served by member 28 in the prior embodiment. The elimination of the contact member 28 thus affords a significant cost reduction in the alternate embodiment just described.

Figure 10:
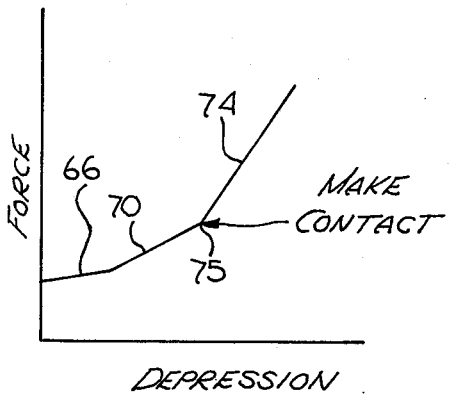
FIG. 10 illustrates the tactile characteristic of the alternate embodiment.

The force curve of the second embodiment is as illustrated in FIG. 10. The line segment 66 represents the resistive force offered by the first actuator member 30. The second line segment 70 represents the total force exerted by the resilience of the first actuator member 30 and the second actuator member 32. The total force represented along line segment 70 is, however, less than the total force as represented by the line segment 68 in FIG. 7. That is to say that the difference in the amount of force increases more sharply in FIG. 7 than it does in FIG. 10, the slope of line segment 70 being less than the slope of line segment 68. In addition, in FIG. 10 the actual point of contact, that is the point at which the second actuator 32 makes physical contact with the contact pad 26, occurs at point 75, the intersection of line segments 70 and 74. Line segment 74 represents the resistive force which occurs after the second actuator member 32 and especially knob 56 thereon makes contact with the contact pad 26. The steepness of line segment 74 results from the short lever arm from the knob 56 to the free end 54 of the second actuator member 32. There is no decrease in force, in the second embodiment, once contact is made nor any other indication that contact has been made other than the fact that the key 10 has been depressed a significant amount. There is no positive tactile feel such as is produced by the assembly shown in FIG. 6. By examination of FIGS. 7 and 10 it is easy to compare the operating characteristics of the actuator assembly 36 of FIG. 6 versus the actuator assembly 36' of FIG. 9. It is clear that the characteristics of the assembly of FIG. 6 are more desirable than the characteristics of the assembly of FIG. 9 although the cost of manufacturing the assembly of FIG. 9 is significantly below that of the assembly of FIG. 6.

The actuator assembly 36' of the present invention is thus unique in that it is capable of functioning as a dual member actuator. It has actuator member 30 and actuator member 32. With a slight modification during the manufacturing process the second actuator member 32 may serve the dual functions of (a) a second actuator member 32 and (b) a contact member. This allows the elimination of an element and reduces the cost of manufacture.

The versatility of the above described actuator assembly 36' can readily be appreciated by those involved in the industry who always must be conscious of the cost required to produce a switching mechanism for a keyboard.

It is of course contemplated that various modifications, changes, additions and alterations in construction may be made to the device of the present invention without departing from the spirit and scope of the invention. Such changes are contemplated as within the capabilities of one ordinarily skilled in the art and within the scope of the present invention. While the above invention has been described with respect to the FIGS. 1–10 it is intended that the scope of the invention be limited only by the scope of the appended claims.

What is claimed is:

1. An improved actuator assembly for use in a key, as part of a keyboard, for closing a first electrical contact and a second electrical contact in response to the depression of said key by a user, said improvement comprising:

a first actuator member including a base portion and a free end;

a second actuator member including a base portion and a free end;

said first and second actuator members being integrally formed from the same sheet of metal and joined thereto at said base portion;

said first actuator member being bent at its base such that prior to the assembly of said key the entire length of said first actuator member extends to a first side of the plane of said sheet of metal;

said second actuator member being bent at its base and at a point intermediate said base and its free end such that prior to the assembly of said key only the free end of said second actuator member extends to said first side of the plane of said sheet of metal.

2. The improved actuator assembly of claim 1 wherein said first actuator member comprises:

a first arm extending from said base on one side of said second actuator member;

a second arm extending from said base on the other side of said second actuator member;

said first and second arms being integrally joined at said free end of said first actuator member;

whereby, said first actuator member forms generally a U-shaped configuration.

3. The actuator assembly according to claim 2 wherein each arm of said first actuator member includes at least one bend near said free end such that that portion of each arm between said free end and said bend extends away from and more nearly perpendicular to said plane of said sheet of metal.

4. The actuator assembly according to claim 3 wherein said key, at its base, is resiliently supported by, and in contact with, said first actuator member;

said first contact is located on said first side of the plane of said sheet of metal and spaced above said second contact;

said second actuator member being drawn to said first side of said plane of said sheet of metal above said first contact and allowed to resiliently bias itself to be in constant contact with said first contact;

said first and second actuator members being thereby held in a vertical spaced apart relationship with respect to one another;

whereby initial depression of said key will cause deflection of said first actuator member only;

additional depression of said key will cause deflection of said first actuator member and of said second actuator member and said first contact; and further depression of said key will cause said first contact to close with said second contact.

5. The actuator assembly according to claim 4 wherein the graph of force resisting movement of said key versus depression of said key:

during initial depression of said key is defined by a first line segment having a first slope; and during additional depression of said key is defined by a second line segment having a second slope greater than said first slope; and during said further depression of said key is defined by a third line segment having a negative slope.

6. An improved actuator assembly for use in a key, as part of a keyboard, for closing a first electrical contact and a second electrical contact in response to the depression of said key by a user, said improvement comprising:

a first actuator member including a base portion and a free end;

a second actuator member including a base portion and a free end;

said first and second actuator members being integrally formed from the same sheet of metal and joined thereto at said base portion;

said first and second actuator members being bent at their base such that the entire length of said first and second actuator members extend to a first side of the plane of said sheet of metal;

said second actuator member forming said first electrical contact;

said second actuator member being bent such that said second actuator member lies below said first actuator member and above said second electrical contact, said first and second actuator members being in a vertical spaced apart relationship.

7. The improved actuator assembly of claim 6 wherein said first actuator member comprises:

a first arm extending from said base on one side of said second actuator member;

a second arm extending from said base on the other side of said second actuator member;

said first and second arms being integrally joined at said free end of said first actuator member;

whereby, said first actuator member forms generally a U-shaped configuration.

8. The improved actuator assembly of claim 7 wherein each arm of said first actuator member includes at least one bend near said free end such that that portion of each arm between said free end and said bend extends away from and more nearly perpendicular to said plane of said sheet of metal.

9. The improved actuator assembly of claim 8 wherein said key, at its base, is resiliently supported by and in physical contact with said free end of said first actuator member;

whereby the initial depression of said key will cause deflection of said first actuator member only; additional depression of said key will cause deflection of said first and second actuator members; further depression of said key will cause said second actuator member to engage said second contact thereby completing an electrical coupling.

10. An improved actuator assembly for use in a key, as part of a keyboard, for engaging a first electrical contact and a second electrical contact in response to the depression of said key by an operator, said improved actuator assembly comprising:

a first actuator member including a free end and a base portion;

a second actuator member including a free end and a base portion;

said first and second actuator members being integrally formed from the same sheet of metal and joined thereto at said base portion;

said first actuator member being bent at its base such that the entire length of said first actuator member extends to a first side of the plane of said sheet of metal, said free end of said first actuator being in physical contact with, and resiliently supporting said key;

said first electrical contact being disposed on said first side of said plane and spaced apart and above said second electrical contact;

said second actuator member being bent at its base and at a point along the length of said actuator such that prior to the assembly of said key only said free end extends to said first side of said plane;

said second actuator member being drawn during assembly to said first side of said plane above said first contact and allowed to resiliently bias itself in physical contact with said first electrical contact;

said first and second actuator members being held in a vertical spaced apart relationship with respect to one another;

whereby the initial depression of said key will cause deflection of said first actuator member only; additional depression of said key will cause deflection of said first and second actuator members and said first contact; further depression of said key will cause said first contact to engage said second contact thereby completing an electrical coupling.

11. The improved actuator assembly according to claim 10 wherein the graph of force resisting movement of said key versus depression of said key:

during initial depression of said key is defined by a first line segment having a first slope; and during additional depression of said key is defined by a second line segment having a second slope greater than said first slope; and during said further depression of said key is defined by a third line segment having a negative slope.

* * * * *